US005380041A

United States Patent [19]

Bowman

[11] Patent Number: 5,380,041

[45] Date of Patent: Jan. 10, 1995

[54] PROTECTIVE BOOT FOR HEEL ENDS OF SKIS

[76] Inventor: Robert G. Bowman, 3233 S. Dexter, Denver, Colo. 80222

[21] Appl. No.: 132,537

[22] Filed: Oct. 6, 1993

[51] Int. Cl.[6] ..... A63C 11/02

[52] U.S. Cl. ..... 280/815; 280/814

[58] Field of Search ..... 280/814, 815; 224/917; 294/147; D3/36, 37, 38

[56] References Cited

U.S. PATENT DOCUMENTS

| | | | |
|---|---|---|---|
| 2,991,859 | 7/1961 | Kaplan | D3/36 X |
| 3,029,855 | 4/1962 | Telford | D3/36 X |
| 3,767,036 | 10/1973 | McLeod | 294/147 X |
| 4,012,050 | 3/1977 | Miller | 280/815 |
| 4,063,581 | 12/1977 | Williams | D3/36 X |
| 4,131,289 | 12/1978 | Maller | 280/814 |
| 4,456,284 | 6/1984 | Saka | 280/812 |
| 4,772,047 | 9/1988 | Leaf | 280/815 |
| 4,778,710 | 10/1988 | Deutsch | 280/608 |
| 4,830,403 | 5/1989 | Ohmori | 280/815 |
| 4,842,134 | 6/1989 | Chang | D3/36 X |
| 5,022,678 | 8/1991 | Mayfield | 280/815 |
| 5,066,044 | 11/1991 | Adasek | 280/815 |
| 5,104,017 | 4/1992 | Vandagriff | 224/205 |

FOREIGN PATENT DOCUMENTS

| | | | |
|---|---|---|---|
| 2265424 | 10/1975 | France | 280/814 |
| 3439278 | 8/1985 | Germany | 280/814 |
| 97838 | 1/1940 | Sweden | 280/815 |
| 581487 | 11/1976 | Switzerland | 280/814 |
| 80/01761 | 9/1980 | WIPO | 280/814 |

*Primary Examiner*—Brian L. Johnson

*Attorney, Agent, or Firm*—John R. Flanagan

[57] ABSTRACT

A boot for protecting heel ends of a pair of skis includes a pocket-shaped body having a pair of side walls, a pair of end walls extending between and interconnecting the side walls and a bottom wall extending between and connecting the lower ends of the side walls and end walls. The side, end and bottom walls together forming a cavity open at a top end for receiving the heel ends of a pair of skis. The bottom wall is of greater thickness than the side and end walls. The pocket-shaped body is made of a material sufficiently flexible and resilient to removably fit over the heel ends of the skis and to grip the surfaces thereon. A plurality of raised ribs are formed on the exterior of lower end portions of the side walls of the pocket-shaped body for gripping by the user to pull the body off from the heel ends of the skis. A plurality of protuberances are spaced apart and formed on and protrude outwardly from the exterior of the bottom wall for absorbing shock to, and providing traction at, the heel ends of the skis when received in the pocket-shaped body.

18 Claims, 1 Drawing Sheet

PROTECTIVE BOOT FOR HEEL ENDS OF SKIS

BACKGROUND OF THE INVENTION

1. Field of the Invention

The present invention generally relates to devices for protecting snow skis against damage and, more particularly, is concerned with a boot for protecting the heel ends of a pair of skis.

2. Description of the Prior Art

Most downhill snow skis are composite laminated structure which tend to be long, heavy and bulky, and so are awkward to carry. Typically they are carried by use of a carrier accessory or by being placed on the skier's shoulder and held with one hand and the poles held with the other hand. When carried on the shoulder, the skis are put bottom sides face-to-face where they are held together by the brakes of the skis. However, the ski brakes are part of the bindings and so are located at the centers of the skis, leaving nothing on the front and rear ends of the skis to keep them in place. As they are carried, the skis frequently start to separate and form a large X and thereby become unmanageable since the person's other hand is occupied with holding the ski poles. As a result, the skis are partially or fully dropped which may result in damage to the ski ends, edges, bindings, etc. Also, during loading and unloading, the skis are typically leaned up against the side of the vehicle where they are easily bumped and knocked to the ground where again such damage may result.

Thus, it is readily appreciated that most downhill skis are exposed to damage by dropping, either while being carried or while standing or leaning against a stationary support, such as a wall of a building or side of a vehicle. Such events typically result in contacts or impacts with hard surfaces which can generate cracks that propagate as the skis flex during use and progressively delaminate the ski structure and loosen the bindings which are screwed to the skis. Such damage to the structure of the skis and the bindings place the skier at risk of serious injury.

A variety of devices have been proposed in the prior patent art for protecting the snow skis from such impacts. Representative examples of such protective devices are the ones disclosed in Leaf U.S. Pat. No. (4,772,047), Ohmori U.S. Pat. No. (4,830,403), Adasek U.S. Pat. No. (5,066,044) and Vandagriff U.S. Pat. No. (5,104,017).

One design approach to providing a protective device is disclosed in the Leaf patent. This design provides a T-shaped member having a longitudinal portion which extends between the heel ends of the skis and a crossbar portion at the end of the longitudinal portion which engages the terminus of the ski heel ends. A strap is then stretched around the heel ends to retain the device in place.

Another design approach to providing a protective device is disclosed in the Ohmori, Adasek and Vandagriff patents. This design provides a sleeve which slips and snugly fits over the heel ends of the skis. The sleeve design approach appears to offer more potential as an effective way to protect the heel ends of snow skies.

However, a need exists for many more refinements and improvements of the sleeve design before its optimum effectiveness can be realized.

SUMMARY OF THE INVENTION

The present invention provides a protective boot designed to satisfy the aforementioned need. The boot of the present invention provides enhanced protection of the heel ends of a pair of skis by incorporating features which will absorb the shock to the different places on the heel ends where impacts are normally expected to be encountered during transport and handling of the skis. The boot also incorporates features which tend to grip the ground or paved surface and thereby provide traction, especially in snow, to prevent the heel ends of the skis from slipping as the skis are leaned up against the upright stationary support surface. At the same time, the boot of the present invention incorporates features which enhance the ease by which the boot can be installed on and removed from the ski heel ends.

Accordingly, the present invention is directed to a boot for protecting heel ends of a pair of skis from damaging impacts with hard surfaces. The boot comprises: (a) a pocket-shaped body forming a cavity open at a top end for receiving and releasing heel ends of a pair of skis when moved in a first direction relative to the body into and from the cavity, the body being made of a material sufficiently flexible and resilient to stretch and releasably fit over the heel ends of the skis and to grip the surfaces thereon; and (b) a plurality of raised members formed on an exterior surface of the body and extending in a second direction oriented in a transverse relationship to the first direction, the raised members adapted to be gripped by a user to pull the body over and from the heel ends of the skis.

The pocket-shaped body has a pair of side walls, a pair of end walls extending between and interconnecting the side walls and a bottom wall extending between and connecting the lower ends of the side walls and end walls. The side walls, end walls and bottom wall together form the cavity of the body. The bottom wall has a greater thickness than the side and end walls.

The body has a bottom end located opposite the top end. The bottom end, which includes the bottom wall, has an exterior bottom surface section and pairs of opposite exterior side and end surface sections. The opposite exterior side and end surface sections have oppositely outwardly protruding middle portions each with upper and lower oppositely inclined surfaces located respectively on the protruding middle portions. The plurality of raised members are formed on the upper inclined surfaces of the exterior side and end surface sections of the bottom end of the body.

The boots have a plurality of protuberances spaced apart from one another and formed on and protruding from the bottom surface section and the lower inclined surfaces of the exterior end surface sections of the bottom end of the body. The protuberances being of truncated conical shape are adapted to absorb shock to, and provide traction at, the heel ends of the skis when received in the body.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 2:
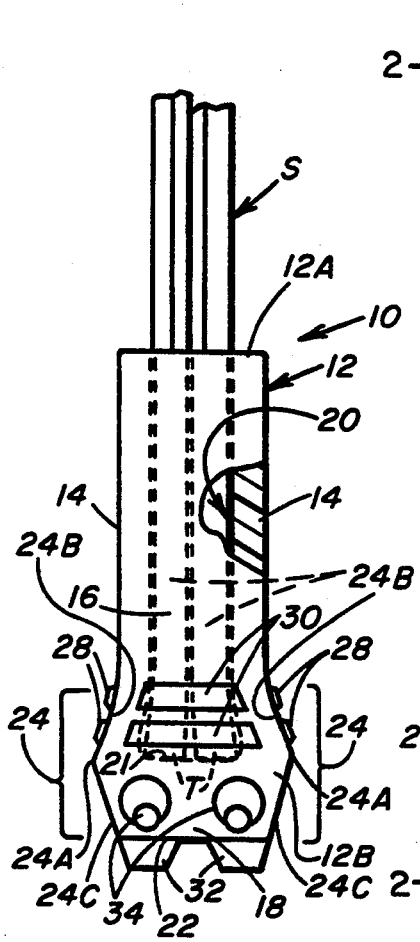
FIG. 2 is an end elevational view of the boot as seen along line 2—2 of FIG. 1.
Figure 1:
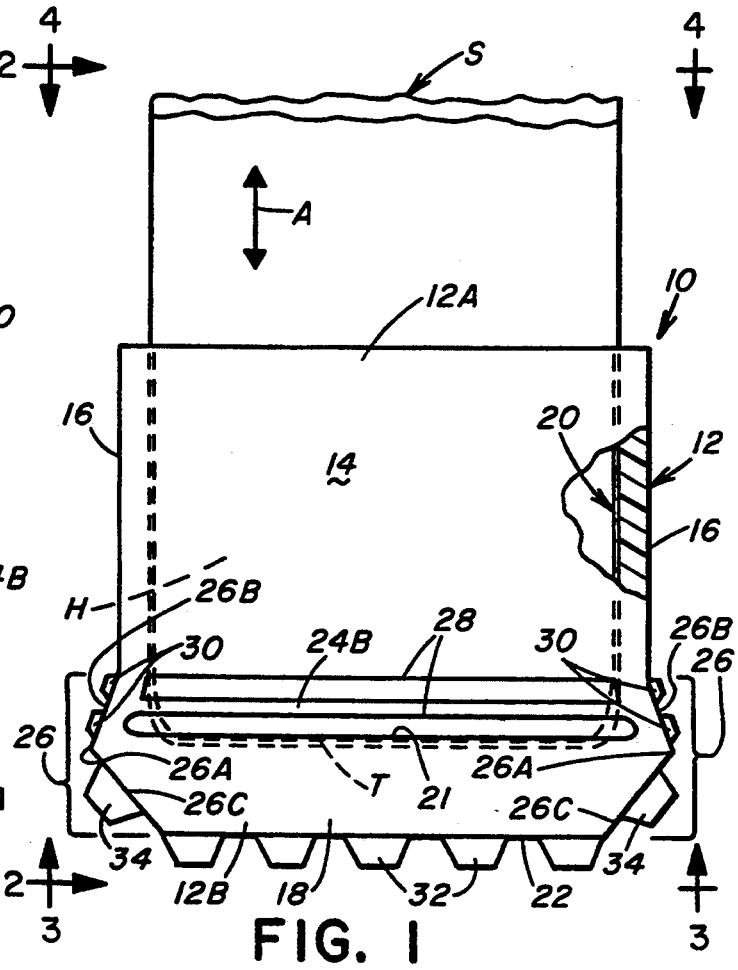
FIG. 1 is a side elevational view of the protective boot of the present invention.

Referring to the drawings and particularly to FIGS. 1 and 2, there is illustrated a protective boot of the present invention, generally designated 10. The boot 10 is specifically adapted for protecting the heel ends H of a pair of skis S, with only the rear portions of the skis S being depicted in the drawings.

Basically, the protective boot 10 includes a pocket-shaped body 12 formed by a pair of side walls 14, a pair of end walls 16 extending between and connecting with the side walls 14 and a bottom wall 18 extending between and connecting the lower ends of the side walls 14 and end walls 16. The side walls 14, end walls 16 and bottom wall 18 together define an interior cavity 20 open at a top end 12A for receiving and releasing the heel ends H of the pair of skis S into and from the interior cavity 20 when moved relative to the body 12 in a first direction along a line A shown in FIG. 1. The bottom wall 18 is of greater thickness than the side walls 14 and end walls 16. The side walls 14 and end walls 16 have the same heights. The side walls 14 have substantially greater lengths than the end walls 16. Overall the cavity 20 has an deep, narrow rectangular configuration. The bottom 21 of the cavity 20 is slightly outwardly flared to seat the rear tips T of the heel ends H of the skis S which are correspondingly slightly bent or turned upwardly relative to the plane of the respective skis. The pocket-shaped body 12 is made of a suitable material, such as a plastic material, sufficiently flexible and resilient to stretch and releasably fit over the heel ends H of the skis S and to grip the surfaces thereon.

The pocket-shaped body 12 has a bottom end 12B located opposite the top end 12A. The bottom end 12B, which includes the bottom wall 18, has an exterior bottom surface section 22 and pairs of opposite exterior side and end surface sections 24, 26. The opposite exterior side and end surface sections 24, 26 have oppositely outwardly protruding middle portions 24A, 26A each with upper and lower oppositely inclined and declined surfaces 24B, 24C and 26B, 26C located respectively on the protruding middle portions 24A, 26A. The upper and lower oppositely inclined and declined surfaces 24B, 24C and 26B, 26C each form an angle of between 10°–20° relative to a vertical plane. The protruding middle portions 24A, 26A are spaced below the top end 12A of the body 12 and above the bottom surface section 22 of the bottom end 12B of the body 12. The middle portions 24A, 24B are located nearer to the bottom surface section 22 of the bottom end 12B of the body 12 than to the top end 12A of the body 12, protruding outwardly in opposite directions from body 12 preferably proximate the elevation of the bottom 21 of the interior cavity 20 above the bottom surface section 22 of the body 12.

Figure 4:
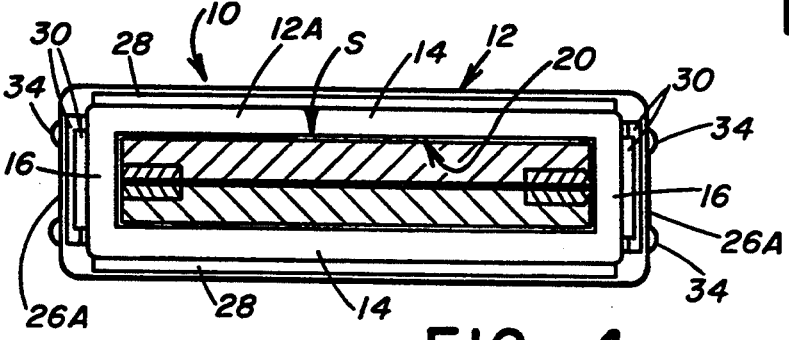
FIG. 4 is a top plan view of the boot as seen along line 4—4 of FIG. 1.

Referring to FIGS. 1, 2 and 4, the protective boot 10 also includes a plurality of raised side and end members 28, 30 in the form of elongated ribs. The ribs 28, 30 are formed on the upper inclined surfaces 24B, 26C of the exterior side and end surface sections 24, 26 of the bottom end 12B of the body 12. The raised side ribs 28 are substantially longer than the raised end ribs 30.

Figure 3:
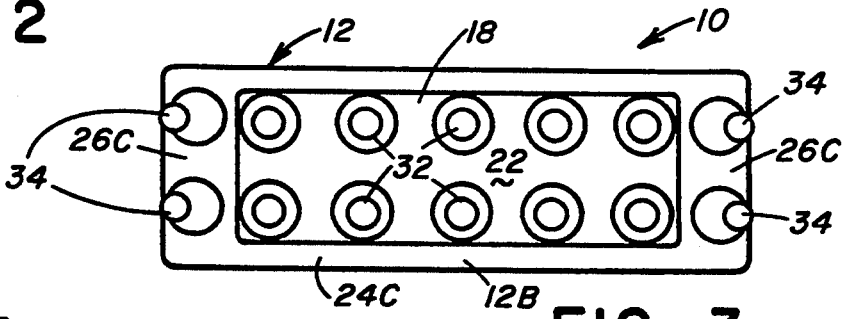
FIG. 3 is a bottom plan view of the boot as seen along line 3—3 of FIG. 1.

Referring to FIGS. 1–3, the protective boot 10 further has a plurality of protuberances 32, 34 spaced apart from one another and formed on and protruding from the bottom surface section 22 and the lower inclined surfaces 26C of the exterior end surface sections 26 of the bottom end 12B of the body 12. Preferably, the protuberances 32, 34 have truncated conical shapes and are adapted to prevent slippage of the boot 10 when the skis S are leaning in a stationary position against a vertical surface. The protuberances 32, 34 function to absorb shock to, and provide traction at, the heel ends H of the skis S when received in the body 12 as the skis are handled and transported by the user.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A boot for protecting heel ends of a pair of skis, comprising:

(a) a pocket-shaped body forming a cavity open at a top end for receiving and releasing heel ends of a pair of skis when moved in a first direction relative to said body into and from the cavity, said body being made of a material sufficiently flexible and resilient to stretch and releasably fit over the heel ends of the skis and to grip surfaces on the skis, said body having a bottom end opposite said top end, said bottom end defining a bottom of said cavity and having an exterior bottom surface section and a pair of opposite exterior side surface sections, said exterior side surface sections having respective middle portions spaced below said top end of said body and above said exterior bottom surface section of said bottom end of said body and located nearer to said bottom surface section of said bottom end than to said top end of said body, said middle portions protruding in opposite directions outwardly from said body proximate the elevation of said bottom of said cavity above said exterior bottom surface section; and (b) a plurality of raised members formed on said outwardly protruding middle portions of said body and extending in a second direction oriented in a transverse relationship to the first direction, said raised members being adapted to be gripped by a user to pull said body over and from the heel ends of the skis.

2. The boot of claim 1 wherein said body has a pair of side walls, a pair of end walls extending between and interconnecting the side walls and a bottom wall extending between and connecting the lower ends of the side walls and end walls, said side walls, end walls and bottom wall together forming said cavity of said body.

3. The boot of claim 2 wherein said bottom wall has a greater thickness than said side walls and end walls.

4. The boot of claim 1 further comprising:

said body having a pair of opposite exterior end surface sections; and a plurality of protuberances spaced apart from one another and being formed on and protruding from said opposite exterior end surface sections of said bottom end of said body, said protuberances being adapted to absorb shock to, and provide traction at, the heel ends of the skis when received in said body.

5. The boot of claim 4 wherein each of said protuberances has a truncated conical shape.

6. The boot of claim 1 further comprising:

a plurality of protuberances spaced apart from one another and being formed on and protruding from said exterior surface of said exterior bottom surface section of said body, said protuberances being adapted to absorb shock to, and provide traction at, the heel ends of the skis when received in said body.

7. The boot of claim 1 wherein said middle portions of said opposite exterior side surface sections have upper and lower oppositely inclined surfaces located on said middle portions, said raised members being formed on said upper inclined surfaces of said exterior side surface sections.

8. The boot of claim 1 wherein said body has a pair of opposite exterior end surface sections having oppositely outwardly protruding middle portions being spaced below said top end of said body and above said exterior bottom surface section of said bottom end of said body and located nearer to said exterior bottom surface section of said bottom end of said body than to said top end of said body, said middle portions of said opposite exterior end surface sections also being located adjacent to and protruding outwardly in opposite directions from said bottom of said cavity.

9. The boot of claim 8 wherein said middle portions of said opposite exterior end surface sections have upper and lower oppositely inclined surfaces located on said middle portions, said plurality of raised members being formed on said upper inclined surfaces of said exterior end surface sections.

10. The boot of claim 9 further comprising:

a plurality of protuberances spaced apart from one another and being formed on and protruding from said lower inclined surfaces of said middle portions of said exterior end surface sections, said protuberances being adapted to absorb shock to, and provide traction at, the heel ends of the skis when received in said body.

11. The boot of claim 10 wherein each of said protuberances has a truncated conical shape.

12. A boot for protecting heel ends of a pair of skis, comprising:

(a) a pocket-shaped body forming a cavity open at a top end for receiving and releasing heel ends of a pair of skis when moved in a first direction relative to said body into and from the cavity, said body being made of a material sufficiently flexible and resilient to stretch and releasably fit over the heel ends of the skis and to grip surfaces on the skis, said body having a bottom end opposite said top end, said bottom end defining a bottom of said cavity and having an exterior bottom surface section and pairs of opposite exterior side and end surface sections, said side and end surface sections having oppositely outwardly protruding middle portions each with upper and lower oppositely inclined surfaces located on said protruding middle portions, said middle portions being spaced below said top end of said body and above said exterior bottom surface section of said bottom end of said body and located nearer to said bottom surface section of said bottom end than to said top end of said body, said middle portions protruding in opposite directions outwardly from said body proximate the elevation of said bottom of said cavity above said exterior bottom surface section; and (b) a plurality of raised members formed on said upper inclined surfaces of said middle portions of said exterior side and end surface sections of said bottom end of said body, said raised members extending in a second direction oriented in a transverse relationship to the first direction, said raised members adapted to be gripped by a user to pull said body over and from the heel ends of the skis.

13. The boot of claim 12 wherein said body has a pair of side walls, a pair of end walls extending between and interconnecting the side walls and a bottom wall at said bottom end extending between and connecting the lower ends of the side walls and end walls, said side walls, end walls and bottom-wall together forming said cavity of said body.

14. The boot of claim 13 wherein said bottom wall has a greater thickness than said side walls and end walls.

15. The boot of claim 12 further comprising:

a plurality of protuberances spaced apart from one another and being formed on and protruding from said bottom surface section of said bottom end of said body, said protuberances being adapted to absorb shock to, and provide traction at, the heel ends of the skis when received in said body.

16. The boot of claim 15 wherein each of said protuberances has a truncated conical shape.

17. The boot of claim 12 further comprising:

a plurality of protuberances spaced apart from one another and being formed on and protruding from said lower inclined surfaces of said middle portions of said exterior end surface sections, said protuberances being adapted to absorb shock to, and provide traction at, the heel ends of the skis when received in said body.

18. The boot of claim 17 wherein each of said protuberances has a truncated conical shape.

* * * * *